US007638952B2

(12) United States Patent
Suzuki

(10) Patent No.: US 7,638,952 B2
(45) Date of Patent: Dec. 29, 2009

(54) MULTIPLE DISCHARGE LAMP LIGHTING APPARATUS

(75) Inventor: Shinichi Suzuki, Kitasaku-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 377 days.

(21) Appl. No.: 11/822,669

(22) Filed: Jul. 9, 2007

(65) Prior Publication Data

US 2008/0074062 A1 Mar. 27, 2008

(30) Foreign Application Priority Data

Jul. 27, 2006 (JP) ..... 2006-204839

(51) Int. Cl.
*H05B 41/16* (2006.01)

(52) U.S. Cl. ..... 315/274; 315/277; 315/224; 315/291; 315/312

(58) Field of Classification Search ..... 315/274–289, 315/224, 209 R, 291–326
See application file for complete search history.

(56) References Cited

U.S. PATENT DOCUMENTS 7,187,139 B2 * 3/2007 Jin ..... 315/274
2007/0145911 A1 * 6/2007 Jin ..... 315/282

FOREIGN PATENT DOCUMENTS

JP U 5-90897 12/1993

* cited by examiner

*Primary Examiner*—Tuyet Vo
(74) *Attorney, Agent, or Firm*—Oliff & Berridge, PLC

(57) ABSTRACT

A multiple discharge lamp lighting apparatus includes first and second transformers and a bridge circuit configured such that four branch paths each including a discharge lamp are connected to form a quadrangle with four sides constituted by the four branch paths, wherein one terminals of two secondary windings of the first transformer are connected to two lamp connection points disposed at two diagonally opposing corners of the quadrangle and one terminals of two secondary windings of the second transformer are connected to another two lamp connection points disposed at the remaining two diagonally opposing corners, and wherein output voltages from the first transformer repeat inversion with their respective polarities reversed, thus constituting a first differential voltage output, and output voltages from the second transformer repeat inversion with their polarities reversed at every cycle of the polarity inversion at the first differential voltage output, thus constituting a second differential voltage output.

8 Claims, 7 Drawing Sheets

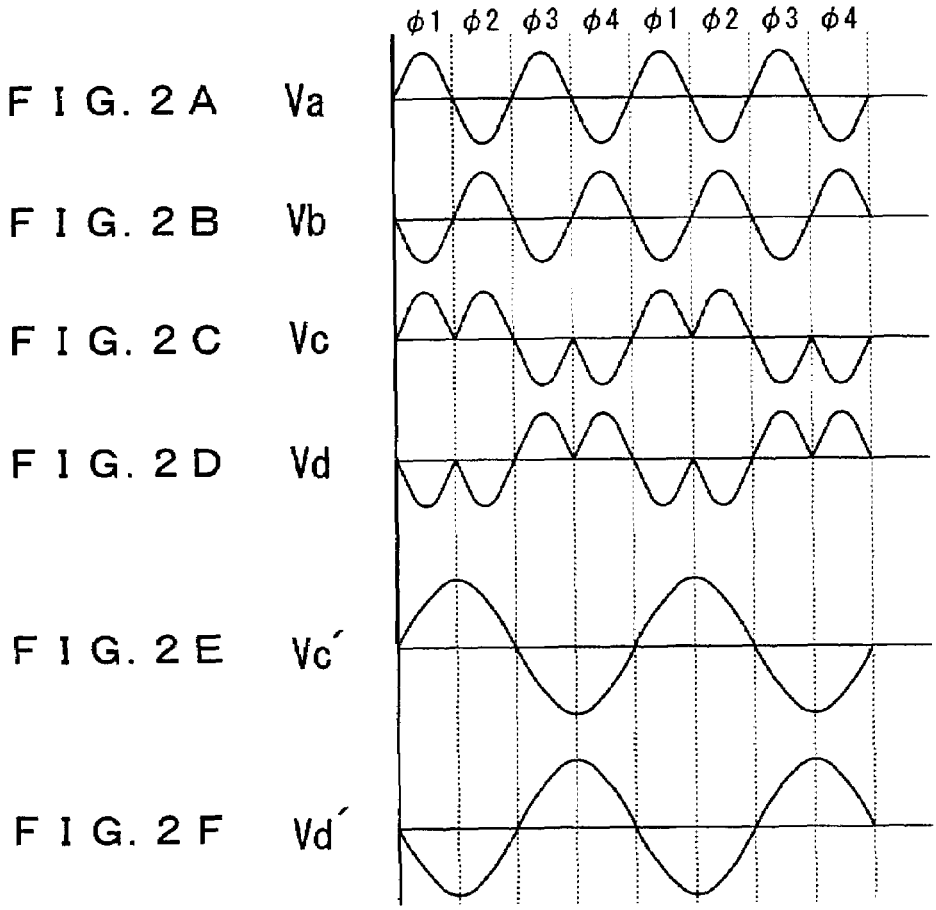
φ1 φ2 φ3 φ4 φ1 φ2 φ3 φ4
FIG. 2A Va
FIG. 2B Vb
FIG. 2C Vc
FIG. 2D Vd
FIG. 2E Vc´
FIG. 2F Vd´

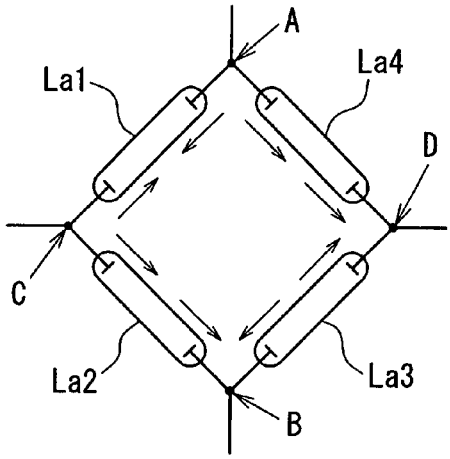
FIG. 4A $\phi 1$
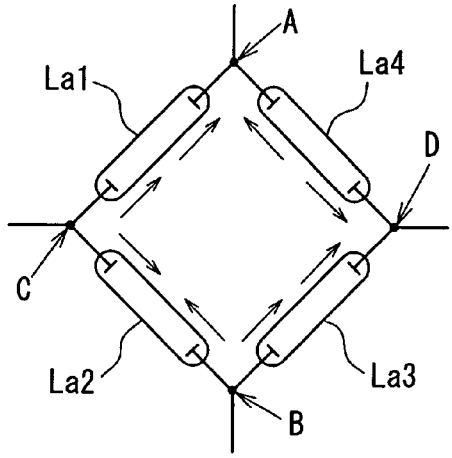
FIG. 4B $\phi 2$
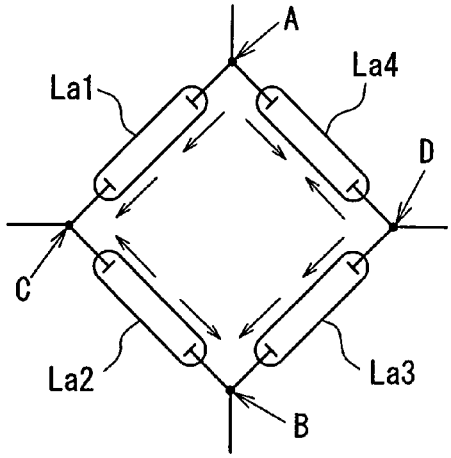
FIG. 4C $\phi 3$
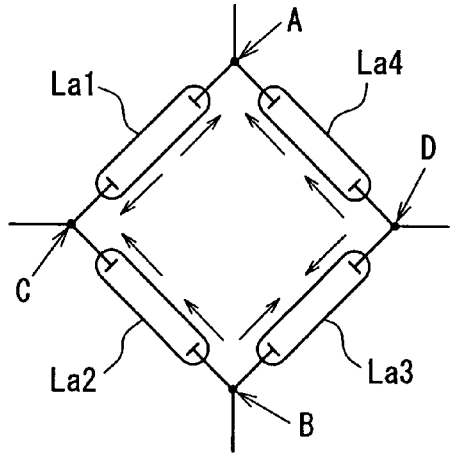
FIG. 4D $\phi 4$ FIG. 5A
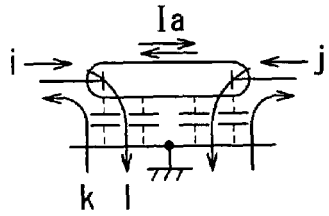
FIG. 5B
FIG. 5C
FIG. 5D
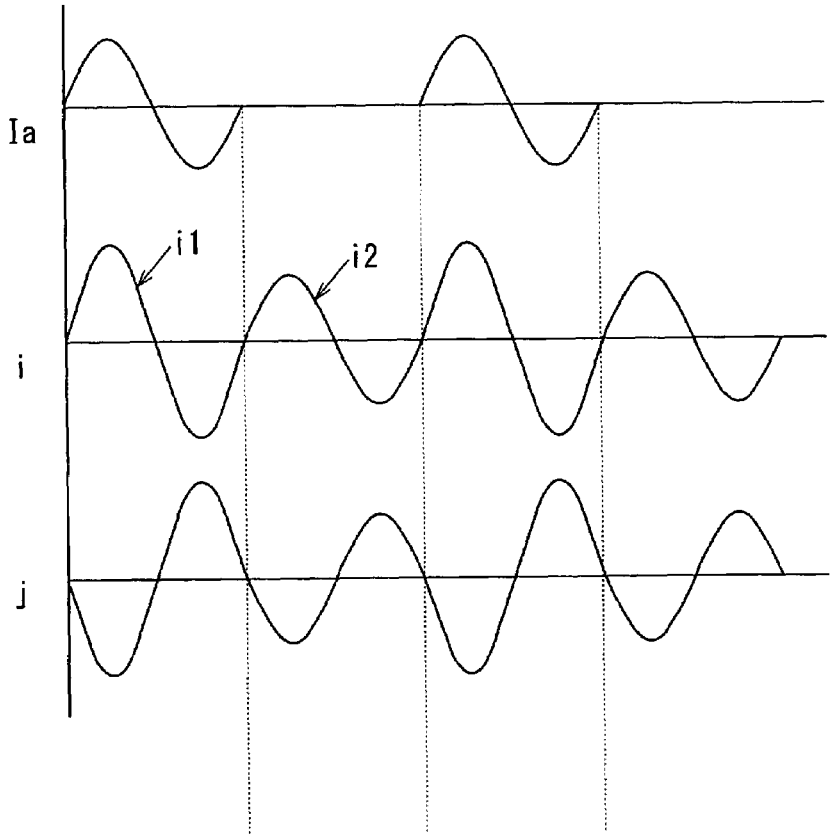

MULTIPLE DISCHARGE LAMP LIGHTING APPARATUS

BACKGROUND OF THE INVENTION

1. Field of the Invention

The present invention relates to a multiple discharge lamp lighting apparatus, and particularly to a multiple discharge lamp lighting apparatus used as a backlight to light a plurality of discharge lamps for a liquid crystal display device.

2. Description of the Related Art

A discharge lamp, for example, a cold cathode lamp, is extensively used as a light source of a backlight for a liquid crystal display (LCD) device. Recently, an LCD device as typified by, for example, a display device for an LCD television, is coming out with a higher brightness and a larger size, and accordingly a multiple lamp backlight with a plurality of discharge lamps is heavily used as a lighting source and at the same time the length of the discharge lamp is increased.

Generally, a high voltage of high frequency is required for lighting a discharge lamp, and therefore a discharge lamp lighting apparatus includes an inverter means to convert a DC voltage into a high-frequency AC voltage, and a step-up transformer to boost the voltage. The primary side of the transformer is driven by the inverter means, and thereby a high high-frequency voltage is generated at the secondary side of the transformer and applied to the discharge lamp, thus the discharge lamp is lit.

In such a discharge lamp lighting apparatus as described above, the following problems are faced when the length of the discharge lamp is increased. If the length of the discharge lamp is increased, the voltage for lighting the discharge lamp must be also increased thus requiring a sufficient withstand voltage for the transformer, which results in difficulties with downsizing. Also, in such a discharge lamp lighting apparatus, usually one electrode of the discharge lamp is grounded together with one terminal of the secondary winding of the transformer, and therefore the potential at an ungrounded electrode fluctuates largely to the ground potential when the discharge lamp is turned on. As a result, a large luminance gradient is caused, especially for a long discharge lamp, with respect to the longitudinal direction of the discharge lamp thus impairing the luminance quality.

In order to overcome the problems described above, a discharge lamp lighting apparatus is disclosed which includes a circuitry as shown in FIG. 8 (refer to, for example, Japanese Utility Model Application Laid-Open No. H5-90897). Referring to FIG. 8, a discharge lamp lighting apparatus 100 includes a first oscillation transformer 121, a second oscillation transformer 125, and oscillation circuits 122 and 126 to drive the first and second oscillation transformers 121 and 125, respectively. One terminals of respective secondary windings 121*s* and 125*s* of the first and second oscillation transformers 121 and 125 are grounded, and the other terminals thereof are connected via respective ballast capacitors 128 to both electrodes of a discharge lamp 127. And, the discharge lamp lighting apparatus 100 is structured such that voltages phased opposite to each other are generated respectively at the terminals of the secondary windings 121*s* and 125*s* connected to the discharge lamp 127.

In the discharge lamp lighting apparatus 100 adapted to light the discharge lamp 127 by the two oscillation transformers 121 and 125, each of voltages generated at the secondary windings 121*s* and 125*s* of the two oscillation transformers 121 and 125 can be reduced by half compared with a discharge lamp lighting apparatus adapted to light a discharge lamp by one transformer, thus making it easy to downsize the transformer, and at the same time the potentials at the both electrodes of the discharge lamp 127 fluctuate equally about the ground potential thus reducing the luminance gradient with respect to the longitudinal direction.

However, the discharge lamp lighting apparatus 100 requires transformers in a number double the number of the discharge lamps to be lit, thus causing a cost increase.

SUMMARY OF THE INVENTION

The present invention has been made in light of the above problems, and it is an object of the present invention to provide a multiple discharge lamp lighting apparatus which incorporates a circuit configuration to include transformers provided at both electrodes of discharge lamps, and in which lamp currents of the discharge lamps are kept equalized and the number of components are reduced.

In order to achieve the object described above, according to an aspect of the present invention, there is provided a multiple discharge lamp lighting which includes: a step-up transformer adapted to boost a voltage and defining a primary side and a secondary side having a plurality of discharge lamps connected thereto; and an inverter means adapted to convert a DC voltage into a high-frequency AC voltage and to drive the primary side of the step-up transformer thereby lighting the plurality of discharge lamps. In the multiple discharge lamp lighting apparatus described above: a bridge circuit is provided which is configured such that four branch paths each including at least one discharge lamp are connected to one another so as to form a quadrangle whose four sides are constituted by the four branch paths; the secondary side of the step-up transformer is provided with first and second outputs connected respectively to two lamp connection points disposed respectively at two corners of the quadrangle diagonally opposing each other, and provided also with third and fourth outputs connected respectively to another two lamp connection points disposed respectively at the remaining two corners of the quadrangle diagonally opposing each other; and the first and second outputs repeat inversions with their respective voltage polarities reversed from each other, thus constituting a first differential voltage output; and the third and fourth outputs repeat inversions with their respective voltage polarities reversed from each other at every one cycle of polarity inversion at the first differential voltage output, thus constituting a second differential voltage output.

In the multiple discharge lamp lighting apparatus according to the present invention, the transformer is structured to include four outputs, specifically the first and second outputs adapted to apply the first differential voltage, and third and fourth outputs adapted to apply the second differential voltage, wherein the step of applying a voltage to two branch paths constituting two opposing sides of the quadrangle to form the bridge, and the step of applying a voltage to another two paths constituting the remaining two opposing sides of the quadrangle are repeated alternately, whereby a voltage is applied to each branch path with opposite polarities across the both electrodes of the branch path thereby lighting the discharge lamp included in each branch path.

On the other hand, in a conventional multiple discharge lamp lighting apparatus, in order to apply a voltage to each of four branch paths with opposite polarities across its both electrodes, a transformer must have eight outputs arranged such that one output is provided at each of both electrodes of one branch path. Thus, the multiple discharge lamp lighting apparatus according to the present invention, which includes only four (reduced by half compared with the conventional apparatus) outputs of the transformer, enables a significant reduction in the number of components.

Also, in the multiple discharge lamp lighting apparatus according to the present invention, at the step where a voltage is applied to two branch paths constituting two sides, a voltage of a voltage difference between the first and fourth outputs is applied to one of the two branch paths while a voltage of a voltage difference between the second and third outputs is applied to the other of the two branch paths, and on the other hand, at the step where a voltage is applied to another two branch paths constituting the remaining two sides, a voltage of a voltage difference between the first and third outputs is applied to one of the another two branch paths while a voltage of a voltage difference between the second and fourth outputs is applied to the other of the another two branch paths.

That is to say, since it does not happen that a plurality of branch paths are connected in parallel to each other between any two outputs (the first and fourth outputs, for example) at any steps, the multiple discharge lamp lighting apparatus according to the present invention is free from non-equilibriums of currents caused between multiple branch paths connected in parallel to each other, and thus the lamp currents of the discharge lamps can be kept uniform.

The multiple discharge lamp lighting apparatus according to the present invention may include a plurality of bridges each of which includes first to fourth outputs. In such a structure, the effect of the above-described reduction in the number of components increasingly is enhanced in proportion to an increase in the number of discharge lamps.

In the multiple discharge lamp lighting apparatus according to the present invention, generally, a discharge lamp included in a branch path is combined with peripheral members via a parasitic capacitance, whereby a current via the parasitic capacitance is present at the both terminals of the branch path even when a voltage is not applied to the branch path including such a discharge lamp (that is to say, no potential difference is generated between the both terminals of the branch path), and accordingly the discharge lamp is prevented from lowering in brightness while a voltage is not applied, thus a uniform brightness can be maintained.

The branch path is typically constituted by one discharge lamp but may alternatively be constituted by a series circuit composed of a plurality of discharge lamps connected in series, or a parallel circuit arranged either such that a plurality of discharge lamps are individually connected in parallel to each other or such that a plurality of series connections each including plural discharge lamps are connected in parallel.

In the aspect of the present invention, the first output may have a voltage waveform shaped in a sinusoidal wave, and the second output may have a voltage waveform shaped in a sinusoidal wave phase-reversed from the sinusoidal wave of the first output, in which case the third output may have a voltage waveform composed of half-waves which each correspond to the half-wave of the sinusoidal wave of the first output and which are arrayed continuously with its polarity inverted at every one cycle of the sinusoidal wave of the first output, and the fourth output may have a voltage waveform with its polarity reversed from the polarity of the voltage waveform of the third output.

With the first to fourth outputs arranged to have their voltage waveforms configured as described above, the absolute values of the output voltages are consistently equal to each other at every moment of the fluctuation, and especially while a voltage is applied to two branch paths constituting two sides of the quadrangle of the bridge, a voltage applied to another two branch paths constituting another two sides of the quadrangle is substantially zero.

In this connection, the absolute values of the first and second outputs and the absolute values of the third and fourth outputs do not necessarily have to constantly correspond to each other at every moment of the fluctuation as long as the polarity inversion of the third and fourth output voltages constituting the second differential voltage output is synchronized so as to occur at every one cycle of the polarity inversion of the first and second output voltages constituting the first differential voltage output.

Accordingly, when the first output has a voltage waveform shaped in a sinusoidal wave and the second output has a voltage waveform shaped in a sinusoidal wave phased-reversed from the sinusoidal wave of the first output, it may be arranged that the third output has a voltage waveform shaped in a sinusoidal wave having a frequency equivalent to half of the frequency of the sinusoidal wave of the first output, and the fourth output has a voltage waveform shaped in a sinusoidal wave phase-reversed from the sinusoidal wave of the third output.

In the aspect of the present invention, the step-up transformer may include first and second transformers each having two outputs such that the first and second outputs are constituted respectively by the two outputs of the first transformer, and the third and fourth outputs are constituted respectively by the two output of the second transformer.

With the structure described above, only two transformers are required for one bridge thus providing an advantage in achieving reduction in the number of components. In this connection, when necessary, the step-up transformer may include a transformer having one output such that at least one of the first to fourth outputs is constituted by the one output of the transformer.

In the aspect of the present invention, the step-up transformer may be a leakage transformer, and also the discharge lamp may be a straight lamp, a U-shaped lamp, a quasi U-shaped lamp, a W-shaped lamp, a square U-shaped lamp, or an L-shaped lamp.

The multiple discharge lamp lighting apparatus structured as described above includes a circuit configured such that transformers are provided at the both electrodes of discharge lamps, and allows lamp currents of all the discharge lamps to be kept equal while the number of components can be reduced, thus providing an apparatus suitable for lighting a long discharge lamp used as a light source of a backlight for an LCD device. And, since the number of transformers to generate a high voltage can be reduced, a multiple discharge lamp lighting apparatus with a reliable performance can be provided. Further, since the circuitry can be simplified, the apparatus can be easily downsized.

BRIEF DESCRIPTION OF THE DRAWINGS

FIGS. 2A to 2F are waveform charts of voltages at respective lamp connection points of a bridge for the multiple discharge lamp lighting apparatus of FIG. 1;

FIGS. 4A to 4D are explanatory views of currents at phases shown in FIGS. 2A to 2F;

FIG. 5A is a schematic view of currents flowing in a discharge lamp, and FIGS. 5B to 5D are waveform charts of the currents of FIG. 5A;

DETAILED DESCRIPTION OF THE INVENTION

Figure 1:
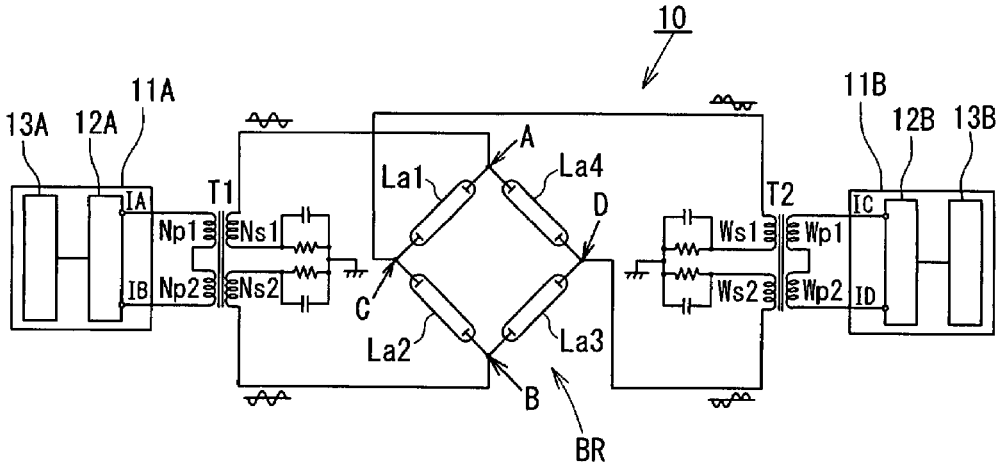
FIG. 1 is a circuit diagram of a multiple discharge lamp lighting apparatus according to a first embodiment of the present invention.

Exemplary embodiment of the present invention will be described with reference to the accompanying drawings, wherein like reference numerals are used throughout to designate like elements and components, and a redundant description will be omitted as appropriate.

Referring to FIG. 1, a multiple discharge lamp lighting apparatus 10 according to a first embodiment of the present invention includes first and second step-up transformers (hereinafter referred to simply as "first and second transformers" as appropriate) T1 and T2, and inverter means 11A and 11B to convert a DC voltage into a high frequency AC voltage. Primary windings Np1 and Np2 of the first transformer T1 are driven by the inverter means 11A, and primary windings Wp1 and Wp2 of the second transformer T2 are driven by the inverter means 11B, whereby a plurality (four in the present embodiment) of discharge lamps La1 to La4 connected respectively to secondary windings Ns1, Ns2, Ws1 and Ws2 of the first and second transformers T1 and T2 are lit in a controlled manner.

In the multiple discharge lamp lighting apparatus 10, one electrode of the discharge lamp La1 is connected to one electrode of the discharge lamp La2 (lamp connection point C), one electrode of the discharge lamp La3 is connected to one electrode of the discharge lamp La4 (lamp connection point D), the other electrode of the discharge lamp La1 is connected to the other electrode of the discharge lamp La4 (lamp connection point A), and the other electrode of the discharge lamp La2 is connected to the other electrode of the discharge lamp La3 (lamp connection point B). Thus, a bridge BR is built up with a circuit configured such that the discharge lamps La1 to La4 are connected to one another so as to form a quadrangle ABCD having its four sides constituted by four branch paths each including a discharge lamp.

The first transformer T1 is a leakage transformer, wherein the primary windings Np1 and Np2 are connected in series to each other, and the both terminals of the series connection of Np1+Np2 are connected to respective output terminals IA and IB of the inverter means 11A, and the second transformer T2 is also a leakage transformer, wherein the primary windings Wp1 and Wp2 are connected in series to each other, and the both terminals of the series connection of Wp1+Wp2 are connected to respective output terminals IC and ID of the inverter means 11B. One terminals of the secondary windings Ns1 and Ns2 of the first transformer T1 are connected to ground via respective parallel circuits each composed of a resistor and a capacitor, and one terminals of the secondary windings Ws1 and Ws2 of the second transformer T2 are connected to ground via respective parallel circuit each composed of a resistor and a capacitor.

The other terminal (first output) of the secondary winding Ns1 of the first transformer T1, which is not connected to ground, is connected to the lamp connection point (hereinafter referred to simply as "connection point") A (between the discharge lamps La1 and La4) which constitutes one corner of the quadrangle ABCD of the bridge BR, and the other terminal (second output) of the secondary winding Ns2, which is not connected to ground, is connected to the connection point B (between the discharge lamps La2 and La3) which constitutes a corner of the quadrangle ABCD diagonally opposing the one corner positioned at the connection point A.

Also, the other terminal (third output) of the secondary winding Ws1 of the second transformer T2, which is not connected to ground, is connected to the connection point C (between the discharge lamps La1 and La2) which constitutes one corner of the quadrangle ABCD of the bridge BR, and the other terminal (fourth output) of the secondary winding Ws2, which is not connected to ground, is connected to the connection point D (between the discharge lamps La3 and La4) which constitutes a corner of the quadrangle ABCD diagonally opposing the one corner positioned at the connection point C.

While the present invention is structured such that the primary windings Np1 and Np2 of the first transformer T1 are connected in series to each other, and that the primary winding Wp1 and Wp2 of the second transformer T2 are connected in series to each other, the primary windings Np1 and Np2 of the first transformer T1 may be connected in parallel to each other and connected across the output terminals IA and IB of the inverter means 11A, and the primary windings Wp1 and Wp2 of the second transformer T2 may be connected in parallel to each other and connected across the output terminals IC and ID of the inverter means 11B.

In this connection, the inverter means 11A/11B includes a full-bridge circuit 12A/12B which is connected to the output terminals IA and IB/IC and ID and which functions as a switch means, and a control circuit 13A/13B which drives the full-bridge circuit 12A/12B. Though not shown, the full-bridge circuit 12A/12B is composed of first pair of switch elements connected in series to each other, and second pair of switch elements connected in series to each other and connected in parallel to the series connected first pair of switch elements, wherein each switch element pair is composed of, for example, a P-MOSFET and an N-MOSFET. The inverter means 11A/11B alternately and repeatedly turns on and off the two pairs of switch elements at a predetermined frequency according to a gate voltage outputted from the control circuit 13A/13B thereby converting a DC voltage (Vin: not shown) into a high frequency AC voltage to be applied across the output terminals IA and IB/IC and ID.

The operation of the multiple discharge lamp lighting apparatus 10 described above will now be described with reference to relevant drawings. FIGS. 2A to 2F show waveforms of respective voltages at the connection points A to D of the bridge BR constituted by the discharge lamps La1 to La4, FIGS. 3A to 3D show waveforms of respective voltages applied to the discharge lamps La1 to La4 at phases $\phi$1 to $\phi$4 shown in FIGS. 2A to 2F, and FIGS. 4A to 4D show states of currents at phases $\phi$1 to $\phi$4 shown in FIGS. 2A to 2F.

In the present embodiment, the first/second transformer T1/T2 is a differential twin transformer, wherein respective output voltages of the secondary windings Ns1 and Ns2/Ws1 and Ws2 have the same amplitude and are reverse-phased from each other.

The first transformer T1 is driven such that respective output voltages of the secondary windings Ns1 and Ns2 each define a sinusoidal wave with their respective phases reversed from each other, whereby a differential voltage output (first differential voltage output) is achieved where the respective output voltages are repeatedly inverted with their polarities phased opposite to each other.

Specifically, a voltage Va at the connection point A (first output) to which the secondary winding Ns1 is connected has a sinusoidal wave with a constant cycle period as shown in FIG. 2A, and a voltage Vb at the connection point B (second output) to which the secondary winding Ns2 is connected has a sinusoidal wave with its phase reversed from that of the voltage Va as shown in FIG. 2B.

Accordingly, the first output (voltage Va) and the second output (voltage Vb) generated respectively at the secondary windings Ns1 and Ns2 of the first transformer T1 are polarized respectively positive (+) and negative (−) at phase ϕ1, then in a half cycle from phase ϕ1 have their respective polarities inverted to negative (−) and positive (+) at phase ϕ2, further in a half cycle from phase ϕ2, that is a whole cycle from phase ϕ1, have their respective polarities inverted to positive (+) and negative (−) at phase ϕ3, and still further in a half cycle from phase ϕ3 have their respective polarities inverted to negative (−) and positive (+) at phase 44, thus constituting a differential voltage output with respective polarities repeating inversion at every half cycle in a anti-phase manner.

On the other hand, the second transformer T2 is driven such that respective output voltages of the secondary windings Ws1 and Ws2 each define a waveform composed of half-waves which each correspond to the half-wave of the sinusoidal wave of the output voltage of the secondary winding Ns1/Ns2 of the first transformer T1 and which are arrayed continuously so that respective polarities of the output voltages of the secondary windings Ws1 and Ws2 are inverted at every one cycle of the sinusoidal wave in a anti-phase manner, whereby a differential voltage output (second differential voltage output) is achieved where the respective output voltages are repeatedly inverted with their polarities phased opposite to each other at every one cycle of the polarity inversion at the first differential voltage output by the output voltage of the first transformer T1.

Specifically, a voltage Vc at the connection point C (third output) to which the secondary winding Ws1 is connected has a waveform configured such that half-waves each corresponding to the half-wave of the sinusoidal wave of the secondary winding Ns1/Ns2 of the first transformer T1 (for example, the waveform of the voltage Va shown in FIG. 2A: hereinafter referred to as "reference sinusoidal wave" as appropriate) are arrayed with the polarity inverted at every one cycle of the reference sinusoidal wave as shown in FIG. 2C, more concretely, arrayed such that the polarity is positive (+) at phases ϕ1 and ϕ2, and then in one cycle of the reference sinusoidal wave is inverted to be negative (−) at phases ϕ3 and ϕ4. And, a voltage Vd at the connection point D (fourth output) to which the secondary winding Ws2 is connected has a waveform which, as shown in FIG. 2D, has its polarity reversed from the polarity of the voltage Vc shown in FIG. 2C.

Accordingly, the third output (voltage Vc) and the fourth output (voltage Vd) generated respectively at the secondary windings Ws1 and Ws2 of the second transformer T2 are polarized respectively positive (+) and negative (−) at phases ϕ1 and ϕ2, then in one cycle of the reference sinusoidal wave (that is one cycle of the polarity inversion of the voltages Va and Vb) have their respective polarities inverted to negative (−) and positive (+) at phase ϕ3 and maintained negative (−) and positive (+) through at phase ϕ4, and have their respective polarities again inverted back to positive (+) and negative (−) at next phase ϕ1, thus constituting a differential voltage output with respective polarities repeating inversion at every one cycle.

While the present invention is not limited to any specific frequency of a reference sinusoidal wave, the first transformer T1 is preferably driven so that the frequency of the reference sinusoidal wave ranges somewhere between 30 kHz to 80 kHz.

Figures 3A, 3B, 3C, 3D:
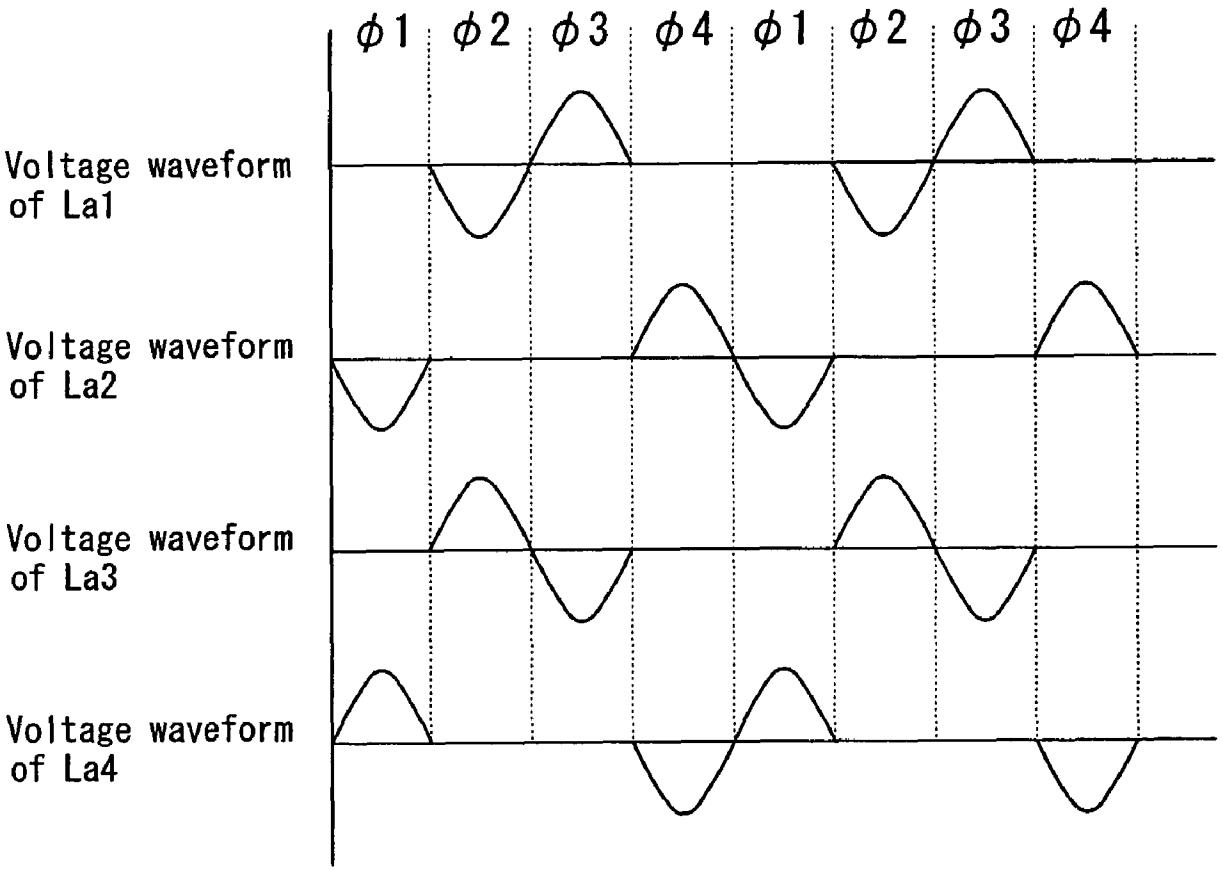
FIGS. 3A to 3D are waveform charts of voltages applied to discharge lamps to be lit by the multiple discharge lamp lighting apparatus of FIG. 1.

FIGS. 3A to 3D show waveforms of the voltages applied to the discharge lamps La1 to La4 according to the variations of the voltages Va to Vd at the connection points A to D under the differential voltage outputs fluctuating as described above. Specifically, the voltage waveform at the discharge lamp La1 shown in FIG. 3A is configured as a result of Va-Vc, the voltage waveform at the discharge lamp La2 shown in FIG. 3B is configured as a result of Vb-Vc, the voltage waveform at the discharge lamp La3 shown in FIG. 3C is configured as a result of Vb-Vd, and the voltage waveform at the discharge lamp La4 shown in FIG. 3D is configured as a result of Va-Vd.

In the multiple discharge lamp lighting apparatus 10 according to the present embodiment, a step (phases ϕ2 and ϕ3) of applying voltages to the discharge lamps La1 and La3 and a step (phases ϕ4 and ϕ1) of applying voltages to the discharge lamps La2 and La4 are alternately repeated as shown in FIG. 3A to 3D, whereby the discharge lamps La1 to La4 are lit.

Consequently, currents flow in the bridge BR at phases ϕ1 to ϕ4 as shown in FIGS. 4A to 4D. Referring to FIG. 4A, at phase ϕ1, a current to flow through the middle of a discharge lamp so as to conduct between its both electrodes (hereinafter referred to as "lamp current") is caused to flow in the discharge lamps La2 and La4 in the respective directions indicated in the figure while a lamp current does not flow in the discharge lamps La1 and La3 (the discharge lamps La1 and La3, however, are not necessarily turned off—this is to be described hereinafter). In the same way, referring to FIG. 4B, at phase ϕ2, a lamp current flows in the discharge lamps La1 and La3 in the respective directions indicated in the figure while a lamp current does not flow in the discharge lamps La2 and La4; referring to FIG. 4C, at phase ϕ3, a lamp current flows in the discharge lamps La1 and La3 in the respective directions indicated in the figure while a lamp current does not flow in the discharge lamps La2 and La4; and referring to FIG. 4D, at phase ϕ4, a lamp current flows in the discharge lamps La2 and La4 in the respective directions indicated in the figure while a lamp current does not flow in the discharge lamps La1 and La3.

Description will now be made on currents flowing in a discharge lamp with reference to FIGS. 5A to 5D. While FIGS. 5A to 5D refer to the discharge lamp La1 as an example for explanation, the explanation applies also to the other discharge lamps La2 to La4.

FIG. 5A shows currents flowing in the discharge lamp La1. While a voltage is applied to the discharge lamp La1 (phases ϕ2 and ϕ3), a lamp current Ia flows at the middle of the discharge lamp La1 as shown in FIG. 5B (in the figure, the direction from the connection point C toward the connection point A is defined as a positive direction of current). Generally, a current attributable to a parasitic capacitance around the discharge lamp La1 (a current k to flow to a parasitic capacitance, or a current l to flow from a parasitic capacitance), in addition to the lamp current Ia, is included among the currents flowing in the discharge lamp La1, and accordingly a current i (shown in FIG. 5C), which flows in one electrode of the discharge lamp La1 while a voltage is applied across the both electrodes of the discharge lamp La1 (at phases ϕ2 and ϕ3), is a compound current i1 represented as:

$$i1=\sqrt{Ia^2+k^2} \text{ or } i1=\sqrt{Ia^2+l^2}$$

Such a current as attributable a parasitic capacitance continues to flow even while a voltage is not applied across the both electrodes of the discharge lamp La1 (at phases ϕ1 and ϕ4), and accordingly the current i to flow in the one electrode of the discharge lamp La1 during this period is a current i2 (refer to FIG. 5C) represented as:

i2=k or i2=l

In the same way, a parasitic current j as shown in FIG. 5D flows in the other electrode of the discharge lamp La1.

Thus, in the multiple discharge lamp lighting apparatus 10 according to the present embodiment, when a voltage is not applied to the discharge lamp La1/La2/La3/La4, currents attributable to a parasitic capacitance are caused to flow in the discharge lamp La1/La2/La3/La4 so that the discharge lamp La1/La2/La3/La4 is kept lighted, whereby deterioration in brightness is prevented and uniformity in brightness is maintained.

In the embodiment described above, the third and fourth output voltages Vc and Vd have waveforms as shown in FIGS. 2C and 2D, respectively, but the present invention does not necessarily have to be arranged such that the absolute values of the first and second outputs and the absolute values of the third and fourth outputs constantly correspond to each other at every moment during the fluctuation as shown in FIGS. 2A to 2D (Va to Vd) as long as the polarity inversion of the third and fourth output voltages constituting the second differential voltage output is synchronized so as to occur at every one cycle of the polarity inversion of the first and second output voltages constituting the first differential voltage output.

For example, if the voltage waveform of the first output is defined as the Va shown in FIG. 2A, and the voltage waveform of the second output is defined as the Vb shown in FIG. 2B, it can be arranged such that the voltage waveform of the third output is configured as Vc' as shown in FIG. 2E, specifically as a sinusoidal wave having a frequency equal to half of the frequency of the reference sinusoidal wave, and the voltage waveform of the fourth output is configured as Vd' phased opposite to the waveform of the aforementioned output voltage Vc' of the third output as shown in FIG. 2F.

Since the multiple discharge lamp lighting apparatus 10 according to the present embodiment includes the first and second transformers T1 and T2 disposed respectively at the both electrodes of the discharge lamps La1 to La4, the voltages generated respectively at the secondary windings Ns1/Ns2 and Ws1/Ws2 are characteristically reduced by half consequently allowing downsizing of the transformers T1 and T2, and the electrode potential at the both electrodes of the discharge lamps La1 to La4 fluctuates equally to the ground potential consequently reducing the brightness gradient with respect to the length direction. In addition, by connecting four discharge lamps to one another in a bridge circuit configuration, the number of transformers required for lighting the four discharge lamps can be reduced to half of the number of the discharge lamps to be lit. With a considerable reduction of the number of transformers to output a high voltage, a multiple discharge lamp lighting apparatus with a reliable performance can be provided, and at the same time the circuitry can be simplified thus allowing easy downsizing of the multiple discharge lamp lighting apparatus.

A second embodiment of the present invention will now be described with reference to FIG. 6. In the description below, any component parts corresponding to those in FIG. 1 are denoted by the same reference numerals, and a detailed description thereof will be omitted as appropriate with a focus put on differences from the first embodiment.

Figure 6:
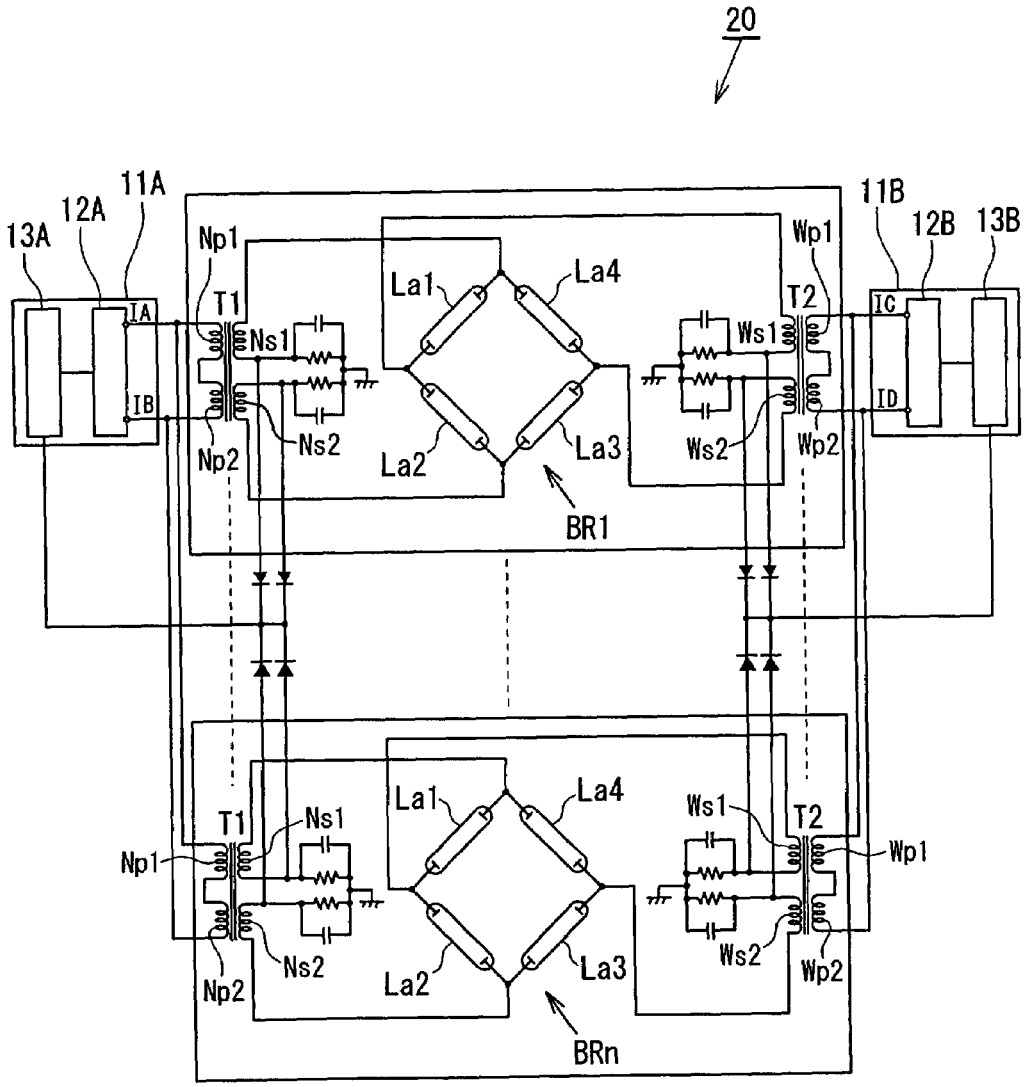
FIG. 6 is a circuit diagram of a multiple discharge lamp lighting apparatus according to a second embodiment of the present invention.

Referring to FIG. 6, a multiple discharge lamp lighting apparatus 20 differs from the multiple discharge lamp lighting apparatus 10 of FIG. 1 in including a plurality (n pieces: n≧2) of bridges BR 1 to BRn each shaped in a quadrangle with four sides constituted by four branch paths each composed of a discharge lamp La1/La2/La3/La4, and a plurality (n pieces: n≧2) of first and second transformers T1 and T2 to drive the bridges BR1 to BRn, respectively. In this connection, an inverter means 11A and an inverter means 11B are used as a common circuit for all the bridges BR1 to BRn and the plurality of first and second transformers T1 and T2.

While the multiple discharge lamp lighting apparatus 20 according to the second embodiment includes an increased number of the first and second transformers T1 and T2 in proportion to an increase in the number of the bridges BR1 to BRn compared with the multiple discharge lamp lighting apparatus 10 of FIG. 1, the number of transformers required for the bridges BR1 to BRn can be reduced to half of the number of discharge lamps to be lit in the same way as in the multiple discharge lamp lighting apparatus 10. Consequently, in the multiple discharge lamp lighting apparatus 20 structured as described above, when a larger number (n) of the bridges are included, the number of the transformers reduced relative to the whole number of the discharge lamps becomes larger, thus providing an advantage in downsizing.

Thus, the multiple discharge lamp lighting apparatus 20 can also be provided with a reliable performance while the circuitry is simplified thereby allowing easy downsizing.

The present invention has been explained with reference to the multiple discharge lamp lighting apparatuses 10 and 20 according to the exemplary embodiments but is not limited thereto, and various modifications and variations are possible within the spirit of the present invention.

For example, the discharge lamps La1 to La4 are straight in the multiple discharge lamp lighting apparatuses 10 and 20 but may each be bent into U-shape, W-shape, square U-shape or L-shape, or alternatively two straight lamps may be connected in series to each other so as to form quasi-U shape.

Figure 7:
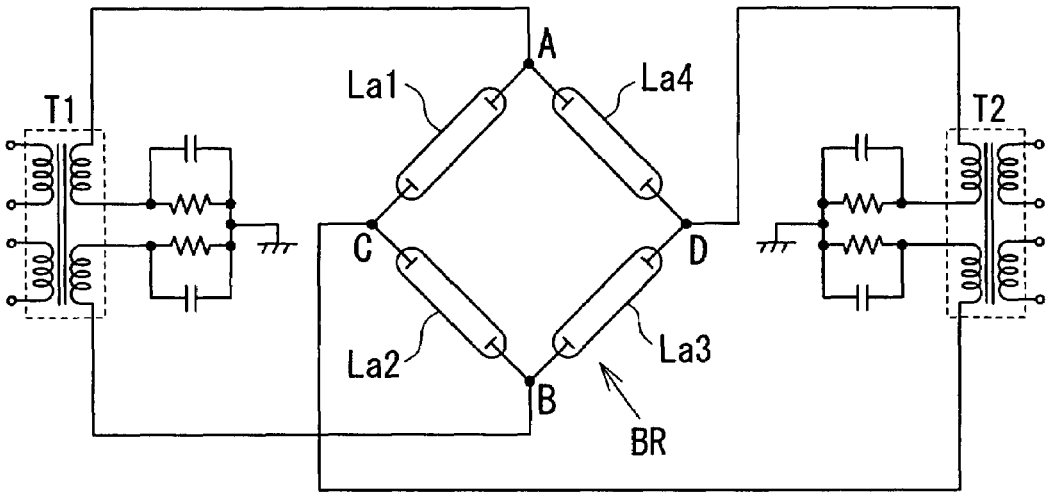
FIG. 7 is a circuitry of an example of an alternative transformer structure for a multiple discharge lamp lighting apparatus according to the present invention.
Figure 8:
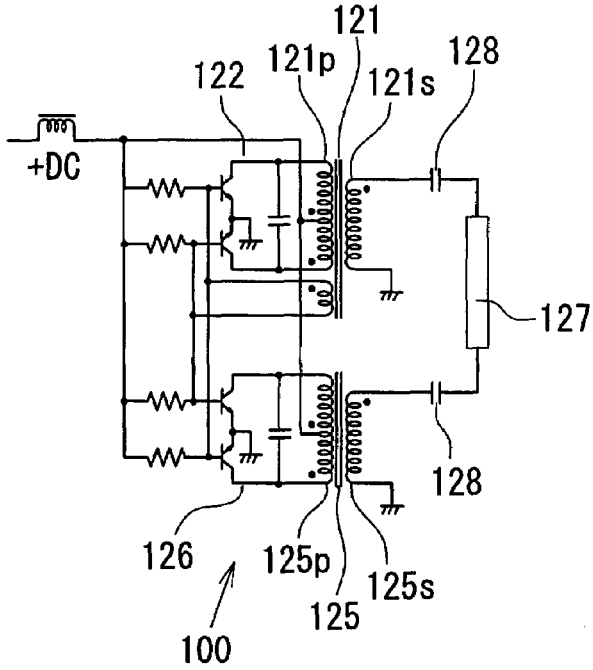
F I G. 8 Prior Art
FIG. 8 is a circuit diagram of a conventional multiple discharge lamp lighting apparatus.

Also, the first and second transformers T1 and T2 do not necessarily have to be a differential twin transformer as described in the embodiments, and all or part of the first to fourth outputs connected respectively to the connection points A to D of the bridge BR shown in FIG. 1 may be constituted by a single transformer with one output. Referring to FIG. 7, the first and second transformers T1 and T2 are each replaced by two single transformers thus using a total of four single transformers. In this connection, transformers providing the first to fourth outputs do not necessarily have to be a leakage transformer.

Further, the branch path for the bridge BR does not have to be constituted by one discharge lamp but may alternatively be constituted by a plurality of discharge lamps connected in series or individually connected in parallel or by a plurality of discharge lamps arranged such that a plurality of series connections each including two or more discharge lamps are connected in parallel to each other.

And, the constituent elements designated by reference numerals 12A and 12B in FIGS. 1 and 6 are a full-bridge circuit in the above description but may alternatively be a half-bridge circuit or a push-pull bridge circuit.

What is claimed is:

1. A multiple discharge lamp lighting apparatus comprising:

a step-up transformer to boost a voltage, the step-up transformer defining a primary side and a secondary side having a plurality of discharge lamps connected thereto; and an inverter means to convert a DC voltage into a high-frequency AC voltage, the inverter means driving the primary side of the step-up transformer thereby lighting the plurality of discharge lamps, wherein:

a bridge circuit is provided which is configured such that four branch paths each comprising at least one discharge lamp are connected to one another so as to form a quadrangle whose four sides are constituted by the four branch paths;

the secondary side of the step-up transformer is provided with first and second outputs connected respectively to two lamp connection points disposed respectively at two corners of the quadrangle diagonally opposing each other, and third and fourth outputs connected respectively to another two lamp connection points disposed respectively at remaining two corners of the quadrangle diagonally opposing each other; and the first and second outputs repeat inversions with their respective voltage polarities reversed from each other, thus constituting a first differential voltage output, and the third and fourth outputs repeat inversions with their respective voltage polarities reversed from each other at every one cycle of polarity inversion at the first differential voltage output, thus constituting a second differential voltage output.

2. The multiple discharge lamp lighting apparatus according to claim 1, wherein the step-up transformer comprises first and second transformers each having two outputs such that the first and second outputs are constituted respectively by the two outputs of the first transformer, and the third and fourth outputs are constituted respectively by the two output of the second transformer.

3. The multiple discharge lamp lighting apparatus according to claim 1, wherein the step-up transformers comprises a transformer having one output such that at least one of the first to fourth outputs is constituted by the one output of the transformer.

4. The multiple discharge lamp lighting apparatus according to claim 1, wherein the step-up transformer is a leakage transformer.

5. The multiple discharge lamp lighting apparatus according to claim 1, wherein the discharge lamp is one of a straight lamp, a U-shaped lamp, a quasi U-shaped lamp, a W-shaped lamp, a square U-shaped lamp, and an L-shaped lamp.

6. The multiple discharge lamp lighting apparatus according to claim 1, wherein the first output has a voltage waveform shaped in a sinusoidal wave, and the second output has a voltage waveform shaped in a sinusoidal wave phase-reversed from the sinusoidal wave of the first output.

7. The multiple discharge lamp lighting apparatus according to claim 6, wherein the third output has a voltage waveform composed of half-waves which each correspond to a half-wave of the sinusoidal wave of the first output and which are arrayed continuously with its polarity inverted at every one cycle of the sinusoidal wave of the first output, and the fourth output has a voltage waveform with its polarity reversed from the polarity of the voltage waveform of the third output.

8. The multiple discharge lamp lighting apparatus according to claim 6, wherein the third output has a voltage waveform shaped in a sinusoidal wave having a frequency equivalent to half of a frequency of the sinusoidal wave of the first output, and the fourth output has a voltage waveform shaped in a sinusoidal wave reversed from the sinusoidal wave of the third output.

* * * * *